US008671600B2

(12) United States Patent
Lu

(10) Patent No.: US 8,671,600 B2
(45) Date of Patent: Mar. 18, 2014

(54) ELECTRIC FIREPLACE

(75) Inventor: Wei Lin Lu, Taichung Hsien (TW)

(73) Assignee: Dongguan Song Wei Electric Technology Co., Ltd. (CN)

( * ) Notice: Subject to any disclaimer, the term of this patent is extended or adjusted under 35 U.S.C. 154(b) by 0 days.

(21) Appl. No.: 13/434,269

(22) Filed: Mar. 29, 2012

(65) Prior Publication Data

US 2013/0258640 A1 Oct. 3, 2013

(51) Int. Cl.
*G09F 19/00* (2006.01)

(52) U.S. Cl.
USPC ..... 40/428

(58) Field of Classification Search
USPC ..... 40/428
See application file for complete search history.

(56) References Cited

U.S. PATENT DOCUMENTS

| | | | |
|---|---|---|---|
| 5,642,580 | A | 7/1997 | Hess et al. |
| 6,047,489 | A | 4/2000 | Hess et al. |
| 6,050,011 | A | 4/2000 | Hess et al. |
| 6,162,047 | A | 12/2000 | Hess |
| 6,269,567 | B1 | 8/2001 | MacPherson et al. |
| 6,350,498 | B1 | 2/2002 | Hess et al. |
| 6,363,636 | B1 | 4/2002 | Hess et al. |
| 6,385,881 | B1 | 5/2002 | Hess |
| 6,393,207 | B1 | 5/2002 | Martin et al. |
| 6,564,485 | B1 | 5/2003 | Hess |
| 6,615,519 | B2 | 9/2003 | Hess |
| 6,691,440 | B1 | 2/2004 | Petz et al. |
| 6,718,665 | B2 | 4/2004 | Hess |
| 6,757,487 | B2 | 6/2004 | Martin et al. |
| 6,968,123 | B2 | 11/2005 | Ravnbo-West et al. |
| 7,134,229 | B2 | 11/2006 | Hess et al. |
| 7,162,820 | B2 | 1/2007 | Hess et al. |
| 7,194,830 | B2 | 3/2007 | Hess |
| 7,210,256 | B2 * | 5/2007 | Rosserot ..... 40/428 |
| 7,373,743 | B1 | 5/2008 | Hess |
| 7,673,408 | B2 | 3/2010 | Hess et al. |
| 7,770,312 | B2 | 8/2010 | Stinson et al. |
| 7,826,727 | B2 | 11/2010 | Bourne |
| 2004/0181983 | A1 | 9/2004 | Hess et al. |
| 2005/0072031 | A1 | 4/2005 | Hess et al. |
| 2005/0097793 | A1 | 5/2005 | Hess |
| 2006/0026894 | A1 | 2/2006 | Hess et al. |
| 2006/0101681 | A1 | 5/2006 | Hess et al. |
| 2006/0162198 | A1 | 7/2006 | Hess et al. |
| 2006/0188831 | A1 | 8/2006 | Hess et al. |
| 2007/0094903 | A1 | 5/2007 | Hess et al. |
| 2007/0107280 | A1 | 5/2007 | Stinson et al. |
| 2007/0224561 | A1 | 9/2007 | Hess et al. |

(Continued)

FOREIGN PATENT DOCUMENTS

| | | |
|---|---|---|
| CN | 1122785 C | 10/2003 |
| CN | 1201110 C | 5/2005 |

(Continued)

*Primary Examiner* — Joanne Silbermann
(74) *Attorney, Agent, or Firm* — Jones Day

(57) ABSTRACT

Disclosed herein are electric fireplaces comprising (a) a shade comprising a plurality of openings; (b) a reflector comprising a shaft and a plurality of flame-shaped reflecting elements; (c) a simulated fuel bed; (d) a light source; and (e) a flame display screen, wherein the flame display screen is located between the reflector and simulated fuel bed, and wherein the shade is located between the light source and the reflector so that light from the light source passes through the plurality of openings of the shade.

16 Claims, 2 Drawing Sheets

(56) References Cited

U.S. PATENT DOCUMENTS

| | | | |
|---|---|---|---|
| 2007/0240344 | A1 | 10/2007 | Wei et al. |
| 2008/0013931 | A1 | 1/2008 | Bourne |
| 2009/0126241 | A1 | 5/2009 | Asofsky |
| 2010/0229849 | A1 | 9/2010 | Asofsky et al. |

FOREIGN PATENT DOCUMENTS

| | | | |
|---|---|---|---|
| CN | 2708144 | Y | 7/2005 |
| CN | 1299049 | C | 2/2007 |
| CN | 1306209 | C | 3/2007 |
| CN | 100339638 | C | 9/2007 |

* cited by examiner

ELECTRIC FIREPLACE

FIELD OF THE INVENTION

This invention generally relates to electric fireplaces comprising a reflector, and more particularly electric fireplaces comprising a reflector having a plurality of flame-shaped reflecting elements.

BACKGROUND OF THE INVENTION

Various types of fireplaces are installed at homes to provide a source of heat and for aesthetic reasons. Fireplaces that are generally available to consumers include traditional wood-burning fireplaces, gas-burning fireplaces and electric fireplaces. Wood-burning fireplaces generally offer the greatest heat-production and aesthetics. However, wood-burning fireplaces not only generally require more work and time to operate, but also present a safety hazard due to the risk of fire spreading into the home. Furthermore, wood-burning fireplaces can be inconvenient and messy because logs must be provided and ashes have to be cleaned. Gas-burning fireplaces offer an actual flame and convenience, but lack the natural sound, flickering, and shadowing associated with wood fires. Gas-burning fireplaces also present safety hazards due to the risks of explosion associated with natural gas combustion.

The current electric fireplaces available in the market offer many safety and convenience features that the wood-burning fireplaces and gas-burning fireplaces do not have. However, although the electric fireplaces can provide simulated flames having visual qualities similar to those of the wood-burning fireplaces or gas-burning fireplaces, they do not offer an actual flame. Generally, the simulated flames lack brightness and transparency of actual flames, and there is no leaping and rising phenomenon of real flickering flames.

Therefore, there is a need for fireplaces that are safe with no risks of fire or explosion. There is also a need for electric fireplaces having simulated flames that more realistically resembles real flames from burning fuels. Furthermore, there is always a need in the market for electric fireplaces with a better design than the current electric fireplaces.

SUMMARY OF THE INVENTION

Provided herein are electric fireplaces comprising a reflector having a plurality of flame-shaped reflecting elements. The electric fireplaces provided herein are believed to satisfy the need for electric fireplaces having more realistic simulated flames.

In one aspect, provided herein is an electric fireplace comprising:

(a) a shade comprising a plurality of openings;

(b) a reflector comprising a shaft and a plurality of flame-shaped reflecting elements;

(c) a simulated fuel bed;

(d) a light source; and (e) a flame display screen, wherein the flame display screen is located between the reflector and simulated fuel bed, and wherein the shade is located between the light source and reflector so that light from the light source passes through the plurality of openings of the shade.

In certain embodiments, the shade disclosed herein is made of light-blocking material.

In some embodiments, each of the plurality of openings disclosed herein is flame-shaped. In certain embodiments, each of the plurality of openings disclosed herein is in the shape of dot, heart, star, oval, circle, triangle, square, rectangle, pentagon, hexagon, heptagon, nonagon, octagon, decagon, arc-shaped, or a combination thereof.

In certain embodiments, at least a portion of each of the plurality of flame-shaped reflecting elements disclosed herein is reflective.

In certain embodiments, the light source disclosed herein comprises a plurality of light emitting elements. In some embodiments, the plurality of light emitting elements in the electric fireplace disclosed herein comprises one or more of incandescent light bulbs, fluorescent light bulbs, gas discharge lamps and light emitting diodes.

In certain embodiments, the electric fireplace disclosed herein further comprises a housing having a front wall having a transparent portion, a top wall, a bottom wall, a rear wall, two side walls or a combination thereof.

In some embodiments, the electric fireplace disclosed herein further comprises a rotating means for rotating the reflector.

In certain embodiments, the electric fireplace disclosed herein further comprises an air blower, a hot air generator or a combination thereof.

In some embodiments, the electric fireplace disclosed herein further comprises a power source and at least one controller. In other embodiments, the at least one controller controls the speed and direction of the reflector, or the intensity of one or more of the light source, or a combination thereof in a manner that produces a moving flame effect.

In certain embodiments, the flame display screen in the electric fireplace disclosed herein has two non-reflecting surfaces, two reflecting surfaces, or one non-reflecting surface and one reflecting surface. In some embodiments, the flame display screen in the electric fireplace disclosed herein has one non-reflecting surface and one reflecting surface, wherein the non-reflecting surface faces the simulated fuel bed. In certain embodiments, the flame display screen in the electric fireplace disclosed herein has one non-reflecting surface and one reflecting surface, wherein the reflecting surface faces the simulated fuel bed.

In some embodiments, the electric fireplace disclosed herein further comprises a fixed light source below the simulated fuel bed.

DETAILED DESCRIPTION OF THE INVENTION

In one aspect, provided herein is an electric fireplace comprising:

(a) a shade comprising a plurality of openings;

(b) a reflector comprising a shaft and a plurality of flame-shaped reflecting elements;

(c) a simulated fuel bed;

(d) a light source; and (e) a flame display screen, wherein the flame display screen is located between the reflector and simulated fuel bed, and wherein the shade is located between the light source and the reflector so that light from the light source passes through the plurality of openings of the shade.

Figure 1:
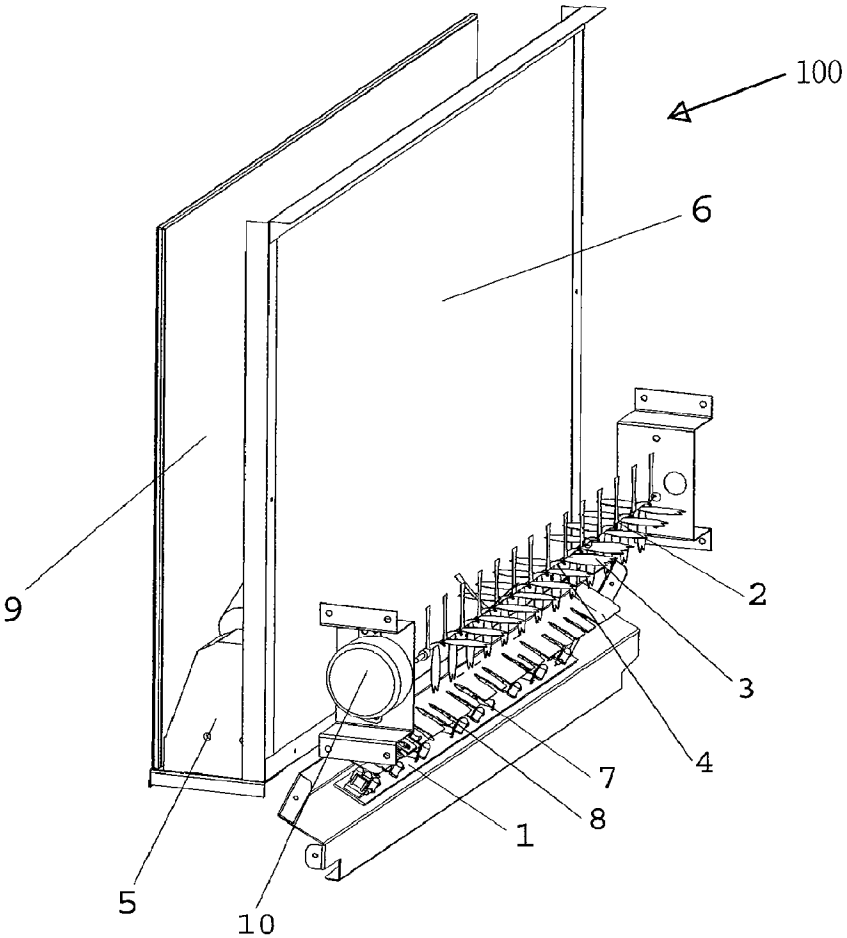
FIG. 1 depicts a perspective view of a first embodiment of an electric fireplace assembly disclosed herein having a front wall, a simulated fuel bed, a flame display screen and a shade comprising a plurality of flame-shaped openings between a reflector having a plurality of flame-shaped reflecting elements and a light source.
Figure 3:
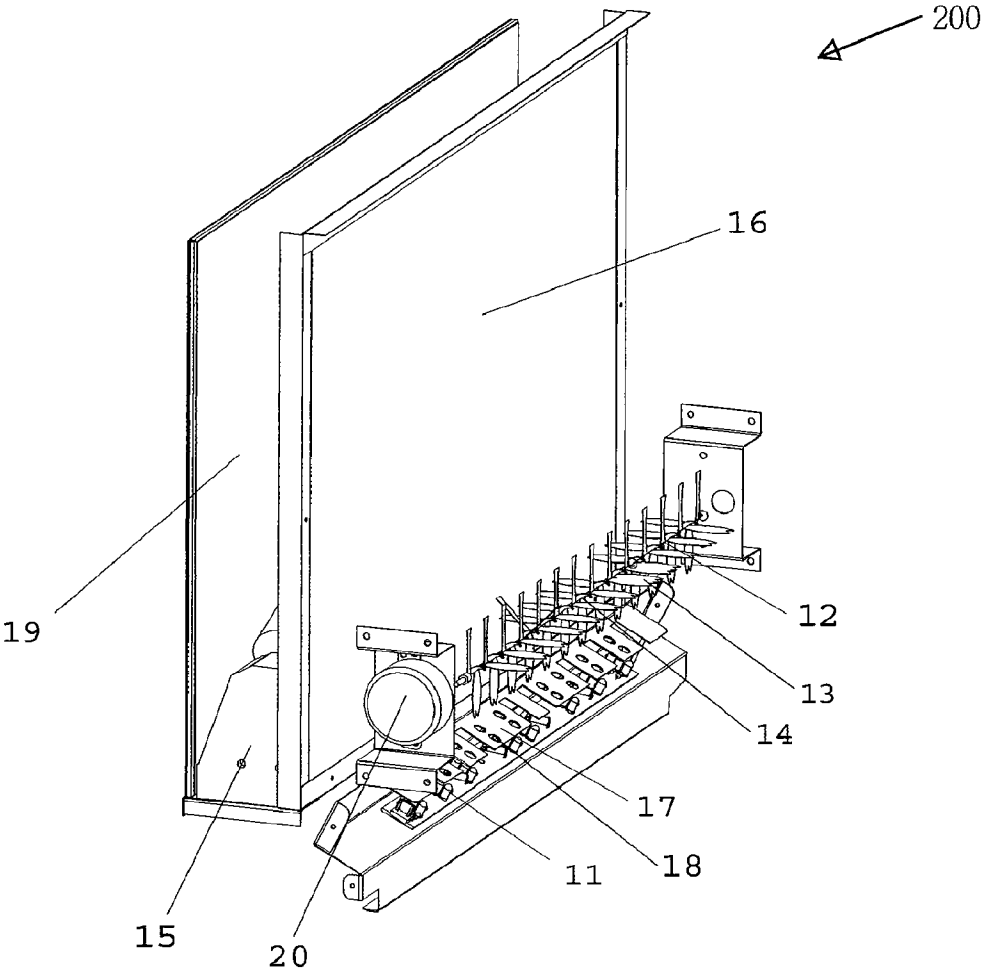
FIG. 3 depicts a perspective view of a second embodiment of an electric fireplace assembly disclosed herein having a front wall, a simulated fuel bed, a flame display screen and a shade comprising a plurality of openings having different shapes between a reflector with a plurality of flame-shaped reflecting elements and a light source.

The shaft, labeled as 4 in FIGS. 1 and 14 in FIG. 3, of the reflector can be in any shape and size that are suitable for placing the flame-shaped reflecting elementsin a manner that can produce a moving flame effect. In some embodiments, the shaft is in the shape of a cylinder, triangular prism, square prism, pentagonal prism, hexagonal prism, heptagonal prism, octagonal prism, nonagonal prism, decagonal prism, or the like. In some embodiments, the shaft is a uniform cylinder having a cross-sectional diameter from 0.1 mm to 50 mm, from 0.1 mm to 10 mm, from 0.1 mm to 5 mm, from 0.1 mm to 2 mm, from 0.1 mm to 1 mm, from 0.5 mm to 10 mm, from 0.1 mm to 0.4 mm, from 0.1 mm to 0.3 mm, from 0.1 mm to 0.2 mm, or from 1 mm to 10 mm. In some embodiments, the cross-sectional diameter of the shaft is not uniform. The shaft can be driven by any known mechanical, electrical or electromechanical devise such as a motor that can be used to move or rotate the shaft. The mechanical or electrical devise can be in turn controlled by any known controller that can control the speed and movement direction of the shaft.

The flame-shaped reflecting elements can be made of reflective material. In some embodiments, the flame-shaped reflecting elements can be made of paper, glass, plastic, metal (e.g., aluminum, silver or mercury), cloth, crystal, stainless steel, quartz or a combination thereof. In certain embodiments, at least a portion of each of the plurality of flame-shaped reflecting elements is reflective. In some embodiments, the reflective portion of the plurality of flame-shaped reflecting elements is from about 25% to about 100%, from about 35% to about 100%, from about 45% to about 100%, from about 55% to about 100%, from about 65% to about 100%, from about 75% to about 100%, from about 85% to about 100% or from about 95% to about 100%. In certain embodiments, the flame-shaped reflecting elements are coloured such as red, orange, yellow, green, blue, indigo, purple, brown, white, black, metallic, silver, gold or a combination thereof.

In certain embodiments, the light source disclosed herein comprises a plurality of light emitting elements. The light emitting elements can be any source that emit light. In some embodiments, the light emitting element can emit light with different colors. In certain embodiments, the light emitting element can emit light with different shapes. In other embodiments, the light emitting element can be a natural gas flame.

In some embodiments, the plurality of light emitting elements in the electric fireplace disclosed herein are incandescent light bulbs, fluorescent light bulbs, gas discharge lamps, light emitting diodes or a combination thereof. Some none-limiting examples of suitable incandescent light bulbs include conventional incandescent light bulbs, halogen lamps, and carbon button lamps. Some none-limiting examples of suitable gas discharge lamps include fluorescent lamps, compact fluorescent lamps, inductive lighting, hollow cathode lamps, neon and argon lamps. plasma lamps, and xenon flash lamps. Some none-limiting examples of suitable light emitting diodes include semiconductor-type light-emitting diodes, organic light-emitting diodes, polymer light-emitting diodes, solid-state lighting and LED lamps.

In some embodiments, the electric fireplace disclosed herein further comprises a means for rotating the reflector. In some embodiments, the rotating means comprises a mechanical device, an electrical device, an electromechanical device or a micro-electromechanical device. In certain embodiment, the rotating means is an electric motor or a hydraulic motor. Some non-limiting examples of electric motors include magnetic motors (such as DC motors, AC motors, and stepper motors), electrostatic motors, and piezoelectric motors. In some embodiments, the rotating means further comprises gears, capable of transmitting torque and rotation through shafts. In some embodiments, the rotating means is powered by a power source and/or controlled by any known controller that can control the speed and movement direction of the reflector.

In certain embodiments, the electric fireplace disclosed herein further comprises a housing. The housing can comprise any component or article that enclosing the elements of the electric fireplace. In some embodiments, the housing has a front wall having a transparent portion, a top wall, a bottom wall, a rear wall, two side walls or a combination thereof. In certain embodiments, the walls are planar or curved or a combination thereof. In some embodiments, the housing is made of wood, plastic, paper, metal, glass, crystal, cloth or a combination thereof. In some embodiments, the housing is colored such as red, orange, yellow, green, blue, indigo, purple, brown, white, black, metallic, silver, gold, a natural wood color or a combination thereof. In certain embodiments, the housing comprises one or more handles, one or more vents, one or more fans or a combination thereof.

In certain embodiments, the electric fireplace disclosed herein further comprises an air blower, a hot air generator or a combination thereof.

In certain embodiments, the electric fireplace disclosed herein further comprises a power source and at least one controller. In other embodiments, the at least one controller controls the speed and movement direction of the reflector, or the intensity of the light source, or a combination thereof in a manner that produces a moving flame effect.

The flame display screen can be any component or article that providing at least one surface for transmitting an image of flames. In certain embodiments, the flame display screen is planar. In some embodiments, the flame display screen includes a curved portion. The flame display screen can be curved in a vertical direction or/and in a horizontal direction to correspond to the profile of the simulated fuel bed. In certain embodiments, the flame display screen is colored. In some embodiments, the flame display screen can be made of plastic, paper, metal, glass, crystal, cloth, quartz or any materials suitable for screen.

In certain embodiments, the flame display screen is located between the reflector and simulated fuel bed, and wherein the light from the light source passes through the plurality of openings of the shade, reflects by the plurality of flame-shaped reflecting elements of the reflector and then transmits on the flame display screen to produce a moving flame effect. In some embodiments, the flame display screen has two non-reflecting surfaces, two reflecting surfaces, or one non-reflecting surface and one reflecting surface. In some embodiments, the flame display screen in the electric fireplace disclosed herein has one non-reflecting surface and one reflecting surface, wherein the non-reflecting surface faces the simulated fuel bed.

In certain embodiments, the flame display screen in the electric fireplace disclosed herein has one non-reflecting surface and one reflecting surface, wherein the reflecting surface faces the simulated fuel bed. In certain embodiments, the flame display screen has two magnifying surfaces, two minifying surfaces, or one magnifying surface and one minifying surface.

The simulated fuel bed can be any component or article that simulating a burning or glowing combustible material. In some embodiments, the simulated combustible materials comprise artificial or simulated wood, logs, charcoal, ember, books, paper, coal, leaf, tree trunks, cloths, photos, bottles or a combination thereof. In other embodiments, the simulated fuel bed comprise artificial or simulated logs and bed of embers so as to create the illusion that burning logs on top of a bed of glowing embers. In some embodiments, the simulated fuel bed comprises a shell and colored to resemble logs and embers for a log burning fire, wherein the shell can be made of plastic or any other materials. In some embodiments, the shell comprises a plurality of light transmitting portions that allows light from a fixed light source under the simulated fuel bed to glow on the top surface of the simulated fuel bed in a pattern similar to a real fuel bed.

The shade comprising a plurality of openings can be any panel or sheet having the plurality of opening that can create or enhance the desirable moving flame effect. In certain embodiments, the shade can be made of a panel of light-blocking material. In some embodiments, each of the plurality of openings is flame-shaped. In certain embodiments, each of the plurality of openings is independently in the shape of dot, heart, star, cloud, bell, moon, flower, balloon, candy, ribbon, fruit, hand, oval, circle, triangle, square, rectangle, pentagon, hexagon, heptagon, nonagon, octagon, decagon, arc-shaped, or a combination thereof. In some embodiments, each of the plurality of openings is irregular shape. In certain embodiments, each of the plurality of openings is regular shape. In some embodiments, each of the plurality of openings is in the shape of polygonal. In some embodiments, the shade is a sheet having non-translucent part and having translucent part which configures the light from the light source into an image of moving flames. In other embodiments, the shade disclosed herein can be made of paper, glass, plastic, metal, cloth, crystal, stainless steel, quartz, leather, wood or a combination thereof. In certain embodiment, the shade is formed from a substantially opaque material. In some embodiment, the shade is formed from substantially reflective material.

In some embodiments, the shade is located between the light source and reflector, and wherein the light from the light source passes through the plurality of openings of the shade, is reflected by the plurality of flame-shaped reflecting elements of the reflector and then is transmitted on the flame display screen to produce a moving flame effect. In certain embodiments, a pattern is cut into a sheet to provide an opening which configures the light from the light source into an image of flames.

In some embodiments, the fireplace further comprises a simulated grate. In certain embodiment, the simulated grate comprises a plurality of prongs, disposed substantially parallel to each other, extending generally upwardly, and disposed substantially along a central part of the simulated fuel bed.

In certain embodiments, the electric fireplace disclosed herein further comprises a fixed light source below the simulated fuel bed. In certain embodiments, the fixed light source comprises a plurality of light emitting elements as disclosed herein. In some embodiments, the fixed light source emits light with different colors. In certain embodiments, the fixed light source emits light with different shapes. In some embodiments, the fixed light source is a natural gas flame.

In certain embodiments, the electric fireplace disclosed herein further comprises any conventional power source or alternative power source. In some embodiments, the power source can be a household electrical source or battery. In certain embodiments, the alternative power source comprise heat, renewable energy, electrical power produced through the use of the gravitational force of falling or flowing water or a combination thereof. In some embodiments, the renewable energy comprises solar, wind energy or a combination thereof. In certain embodiments, the rotating means can be powered by mechanical energy manually supplied to a spring. In some embodiment, the mechanical device can be driven with spring-operated lifting means or weight operated lifting means.

In certain embodiments, the electric fireplace disclosed herein further comprises an air blower. Any air blower that propels air forward can be used herein. Some non-limiting examples of the air blower include forward-curved air blowers, backward-inclined air blowers, backward-curved air blowers, radial air blowers and airfoil air blowers. In certain embodiments, the air blower comprises a humidifier.

In certain embodiments, the electric fireplace disclosed herein further comprises a hot air generator. Any hot air generator that produce hot air can be used herein. In certain embodiments, the hot air generator comprises the humidifier.

In certain embodiments, the electric fireplace disclosed herein further comprises a controller. In some embodiments, the controller comprises one or more modules, including a memory storage means and a user interface. In some embodiments, the controller can include, for example, firmware which provides options selectable by a user via the user interface. In addition, or in the alternative, direct (manual) control by the user via the user interface may be permitted. Alternatively, the controller could be programmed to cause variations in the light produced by the LEDs in accordance with a predetermined sequence in a program stored in memory. In some embodiments, the controller includes any suitable means for causing light created by the light source to vary as required, e.g., a triac to vary voltage as required, as is known in the art. In certain embodiments, the controller is controllable by a user. In some embodiments, the signal from the controller is captured by a sensor. In certain embodiments, the controller controls the speed and movement direction of the reflector, or the intensity of the light source, or a combination thereof in a manner that produces a moving flame effect. In certain embodiments, the controller controls the temperature of the air generated from the air blower or the hot air generator or the intensity level of the humidifier. In some embodiments, the controller can switch on or off the reflector, the air blower or the hot air generator or the intensity level of the humidifier.

FIG. 1 depicts a perspective view of a first embodiment of an electric fireplace assembly 100, showing a light source 1 behind a shade 7. The shade 7 comprising a plurality of flame-shaped openings 8 located below a reflector 2 or 3. The light from the light source passes through the plurality of openings of the shade, is reflected by the plurality of flame-shaped reflecting elements of the reflector and then is transmitted on the flame display screen to produce a moving flame effect. The moving flame effect may be enhanced by using a controller 10 to control the speed and direction of the reflector 2, or the intensity of the light source 1, or a combination thereof. The flame display screen 6 is located immediately behind a simulated fuel bed 5. A fixed light source (not shown) is situated below the simulated fuel bed 5 and affixed to the bottom wall 22. The fixed light source (not shown) comprises a second light source. The second light source comprising a plurality of light emitting elements, which have same or different colors and shine at different intensities at different times in order to give the effect of a flickering fire or a glowing ember. A hot air generator (not shown) is located at the top of the electric fireplace assembly 100.

Figure 2:
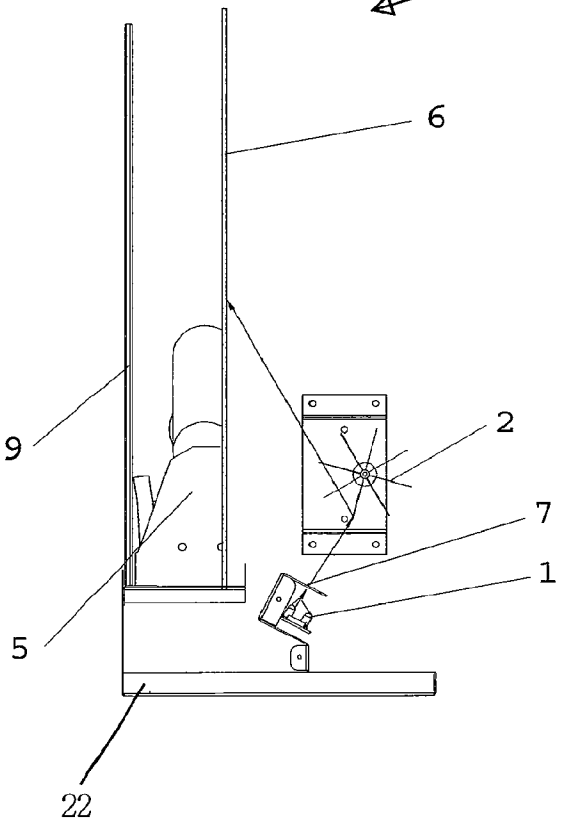
FIG. 2 depicts a side view of the electric fireplace assembly of FIG. 1.

FIG. 2 depicts a side view of the electric fireplace assembly 100 in a housing. The housing has a front wall 9 having a transparent portion, a top wall (not shown), a bottom wall 22, a rear wall (not shown), and two side walls (not shown).

FIG. 3 depicts a perspective view of a second embodiment of an electric fireplace assembly 200, showing a light source 11 behind a shade 17. The shade 17 comprising a plurality of openings 18 having different shape located below a reflector 12 or 13. The light from the light source passes through the plurality of openings of the shade, is reflected by the plurality of flame-shaped reflecting elements of the reflector and then is transmitted on the flame display screen to produce a moving flame effect. The moving flame effect may be enhanced by using a controller 20 to control the speed and direction of the reflector 12, or the intensity of the light source 11, or a combination thereof. The flame display screen 16 is located immediately behind a simulated fuel bed 15. A fixed light source (not shown) is situated below the simulated fuel bed 15 and affixed to the bottom wall 23. The fixed light source (not shown) comprises a second light source. The second light source comprising a plurality of light emitting elements, which has same or different colors and shine at different intensities at different times in order to give the effect of a flickering fire or a glowing ember. A hot air generator (not shown) is located at the top of the electric fireplace assembly 200.

Figure 4:
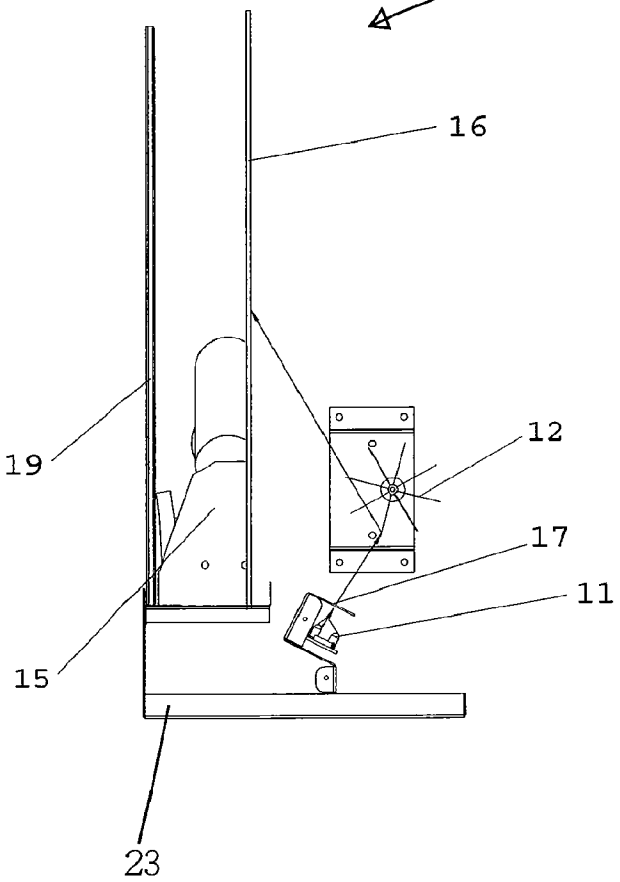
FIG. 4 depicts a side view of the electric fireplace assembly of FIG. 3.

FIG. 4 depicts a side view of the electric fireplace assembly 200 in a housing. The housing has a front wall 19 having a transparent portion, a top wall (not shown), a bottom wall 23, a rear wall (not shown), and two side walls (not shown).

While the invention has been described with respect to a limited number of embodiments, the specific features of one embodiment should not be attributed to other embodiments of the invention. No single embodiment is representative of all aspects of the invention. In some embodiments, the compositions may include numerous compounds not mentioned herein. In other embodiments, the compositions do not include, or are substantially free of, any compounds not enumerated herein. Variations and modifications from the described embodiments exist. For example, the fuel disclosed herein needs not be a mixture of alcohol. It can comprise any type of hydrocarbons or fatty esters or other biofuels. The appended claims intend to cover all such variations and modifications as falling within the scope of the invention.

All publications and patent applications mentioned in this specification are herein incorporated by reference to the same extent as if each individual publication or patent application was specifically and individually indicated to be incorporated by reference. Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. An electric fireplace comprising:

(a) a shade comprising a plurality of openings;

(b) a reflector comprising a shaft and a plurality of flame-shaped reflecting elements;

(c) a simulated fuel bed;

(d) a light source;

(e) a flame display screen; and (f) at least one controller;

wherein the flame display screen is located between the reflector and simulated fuel bed, wherein the shade is located between the light source and reflector so that light from the light source passes through the plurality of openings of the shade, and wherein the at least one controller is configured to change the direction of the reflector from time to time to produce a realistic moving flame effect.

2. The electric fireplace of claim 1, wherein the shade is made of light-blocking material.

3. The electric fireplace of claim 1, wherein each of the plurality of openings of the shade is flame-shaped.

4. The electric fireplace of claim 1, wherein each of the plurality of openings of the shade is in the shape of dot, heart, star, oval, circle, triangle, square, rectangle, pentagon, hexagon, heptagon, nonagon, octagon, decagon, arc-shaped, or a combination thereof.

5. The electric fireplace of claim 1, wherein at least a portion of each of the plurality of flame-shaped reflecting elements is reflective.

6. The electric fireplace of claim 1, wherein the light source comprises one or more of incandescent light bulbs, fluorescent light bulbs, gas discharge lamps and light emitting diodes.

7. The electric fireplace of claim 1, wherein the electric fireplace further comprises a housing having a front wall, a bottom wall, or a combination thereof.

8. The electric fireplace of claim 1, wherein the electric fireplace further comprises a rotating means for rotating the reflector.

9. The electric fireplace of claim 1, wherein the reflector is located above the shade and the light source.

10. The electric fireplace of claim 1, wherein the shade includes a substantially planar surface, and the plurality of openings of the shade are located on the substantially planar surface.

11. The electric fireplace of claim 1, wherein the flame display screen is located substantially above the shade.

12. The electric fireplace of claim 1, wherein the simulated fuel bed is located substantially above, in front of, or parallel to the shade.

13. The electric fireplace of claim 1, wherein the at least one controller is further configured to rotate the reflector in a first direction for a first time period and rotate the reflector in a second direction for a second time period to produce the realistic moving flame effect, the second direction being different from the first direction.

14. The electric fireplace of claim 1, wherein the light source is configured to emit light with different shapes.

15. An electric fireplace comprising:

(a) a shade comprising a plurality of openings, (b) a reflector comprising a shaft and a plurality of flame-shaped reflecting elements, (c) a simulated fuel bed, (d) a light source, (e) a flame display screen, (f) a housing having a front wall, a bottom wall, or a combination thereof, (g) a rotating means for rotating the reflector, and (h) at least one controller, wherein the shade is located between the light source and the reflector so that light from the light source passes through the plurality of openings of the shade and reflects on the reflector, wherein the flame display screen is located between the reflector and the simulated fuel bed so that light from the reflector diffuses on the flame display screen, wherein the shade is made of light-blocking material, wherein each of the plurality of openings of the shade is in the shape of flame, dot, heart, star, oval, circle, triangle, square, rectangle, pentagon, hexagon, heptagon, nonagon, octagon, decagon, arc-shaped, or a combination thereof, wherein at least a portion of each of the plurality of flame-shaped reflecting elements is reflective, wherein the light source comprises one or more of incandescent light bulbs, fluorescent light bulbs, gas discharge lamps and light emitting diodes, and wherein the at least one controller is configured to change the direction of the reflector from time to time to produce a realistic moving flame effect.

16. A method for simulating one or more flames in an artificial fireplace, the method comprising:

receiving light from a light source;

passing the light through a shade comprising a plurality of openings;

reflecting the light on a reflector comprising a shaft and a plurality of flame-shaped reflecting elements, the shade being located between the light source and the reflector, the reflector being rotated by a rotating means; and diffusing the light on a flame display screen located between the reflector and a simulated fuel bed;

wherein the shade is made of light-blocking material, wherein each of the plurality of openings of the shade is in the shape of flame, dot, heart, star, oval, circle, triangle, square, rectangle, pentagon, hexagon, heptagon, nonagon, octagon, decagon, arc-shaped, or a combination thereof, wherein at least a portion of each of the plurality of flame-shaped reflecting elements is reflective, wherein the light source comprises one or more of incandescent light bulbs, fluorescent light bulbs, gas discharge lamps and light emitting diodes, and wherein at least one controller changes the direction of the reflector to produce a realistic moving flame effect.

* * * * *